United States Patent [19]

Tien-Kuei

[11] 4,421,513

[45] Dec. 20, 1983

[54] PROCESS FOR PRODUCING FIBRILLATED POLYESTER

[75] Inventor: Su Tien-Kuei, Spartanburg, S.C.

[73] Assignee: Milliken Research Corporation, Spartanburg, S.C.

[21] Appl. No.: 307,993

[22] Filed: Oct. 2, 1981

Related U.S. Application Data

[60] Division of Ser. No. 1,993, Jan. 8, 1979, Pat. No. 4,331,724, which is a continuation-in-part of Ser. No. 907,920, May 22, 1978, abandoned.

[51] Int. Cl.[3] ..... D06M 5/12

[52] U.S. Cl. ..... 8/130.1; 8/114.6; 8/115.5; 28/159; 28/162

[58] Field of Search ..... 8/130.1, 114.6; 28/159, 28/162

[56] References Cited

U.S. PATENT DOCUMENTS

| | | | |
|---|---|---|---|
| 2,861,865 | 11/1958 | Siggel | 8/130.1 |
| 2,981,978 | 5/1961 | Griffing | 8/130.1 |
| 3,084,020 | 4/1963 | Loosi | 8/130.1 |
| 3,154,374 | 10/1964 | Gruschke et al. | 8/130.1 |
| 3,396,446 | 8/1968 | Eggleston et al. | 528/487 |
| 3,620,666 | 11/1971 | Lenz et al. | 8/130.1 |
| 4,291,442 | 9/1981 | Marco | 8/114.6 |

FOREIGN PATENT DOCUMENTS

| | | | |
|---|---|---|---|
| 56-63067 | 5/1981 | Japan | 28/162 |

*Primary Examiner*—Maria Parrish Tungol

*Attorney, Agent, or Firm*—H. William Petry; Terry T. Moyer

[57] ABSTRACT

Fibrillated polyester textile materials and methods for producing same are disclosed. Such fibrillated polyester textile materials have a body portion formed of a plurality of polyester filaments in which the filaments contain a plurality of fibrils on the convex side portion of the filament curvature pointing away from the body portion of the textile material. The methods disclosed include treating the polyester textile material with a swelling agent and abrading the resulting material to produce the desired fibrillated polyester textile material. Also disclosed is a unique method wherein the molecular weight of the polyester employed to make up the textile material is lowered prior to the polyester textile material being treated with the swelling agent and abraded.

6 Claims, 12 Drawing Figures

PROCESS FOR PRODUCING FIBRILLATED POLYESTER

This is a division of pending application Ser. No. 001,993, filed Jan. 8, 1979 now U.S. Pat. No. 4,331,724 which is in turn a continuation-in-part of my co-pending application, Ser. No. 907,920, filed on May 22, 1978 now abandoned.

Durable clothing at affordable prices—this has long been the promise of polyester. While this promise has been fulfilled, some have complained that clothing made from polyester does not provide the warmth and comfort of cotton and other natural fibers but rather feels harsh and stiff. It has been suggested that the ideal fiber would have the appearance and feel of cotton or wool while retaining the strength and low cost of polyester.

It has also been suggested that some of the less desirable features of many polyester fabrics are due to the common practice of constructing these fabrics from continuous filament yarns which are relatively smooth and stiff as compared to yarns made from naturally occurring fibers in staple form. Therefore, in an effort to make polyester yarn as similar to wool or cotton as possible, polyester fibers of relatively low denier have been cut into short lengths to form tow which is then spun to form yarn. Often cotton or wool is incorporated into the yarn along with the polyester. This approach has been very successful in providing attractive, rather comfortable clothing, but it does have drawbacks. Not only does this procedure entail the complications of extruding many fine filaments, forming tow from them and spinning the tow into yarn, but the resulting yarn is also weaker than continuous filament yarns of comparable denier.

The fertile mind of man has not been content to merely imitate nature by forming staple yarns from polyester but has also developed strong, attractive texturized yarns which can be formed by performing bulking operations on thermoplastic synthetic filaments. The most common of these bulking operations are false twist texturizing and edge crimping, both of which result in resilient, light-weight but strong and bulky yarns. False twist texturized polyester yarns have gained wide acceptance in many applications because of their low cost and attractive appearance, but again there are drawbacks. In particular, some fabrics containing false twist texturized polyester have a tendency to pick, that is, to form small clumps of fiber on or near the surface of the yarn. Further, many of these fabrics have what is termed a plastic feel, that is, they are rather slick and have a relatively stiff hand. Also, many of these fabrics are not as opaque as fabrics formed from staple yarns which often causes undergarments to be undesirably visible through outerwear.

An object of the present invention is to provide a polyester textile material which simulates the feel, opacity, bulk and appearance of textile materials formed of natural fibers.

Another object of the invention is to provide a method of fibrillating polyester fibers or filaments of a polyester textile material.

Various other objects, advantages, and features of the invention will become apparent to those skilled in the art from a reading of this disclosure.

Drawings accompany and are made a part of this disclosure. These drawings depict preferred specific embodiments of the fibrillated polyester textile material of the invention, and it is to be understood that the drawings are not to unduly limit the scope of the invention. In the drawings.

Figure 1:
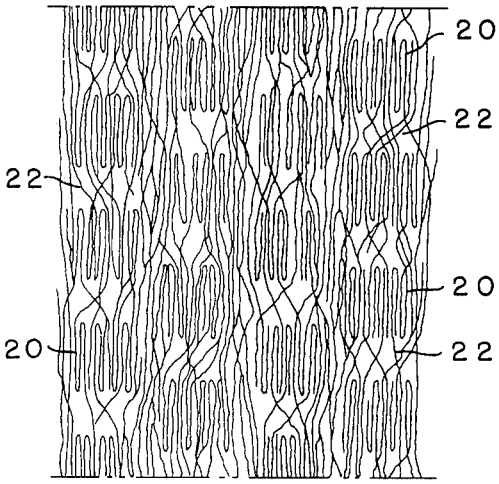
FIG. 1 is a schematic representation of the fibrous polymer chains within a polyester filament.

In the following discussion and description of the invention, reference will be made to the drawing wherein the same reference numerals will be used to indicate the same or similar parts and/or structure. The discussion and description is of specific embodiments of the fibrillated polyester textile material of the invention, and it is to be understood that the discussion and description is not to unduly limit the scope of the invention.

At present, polyethylene terephthalate is the polyester which is most widely used in textiles. Its chemical composition may be represented as

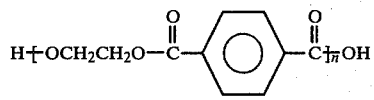

where n is a large number usually in the range of from about 25 to about 100. This molecule is hydrophobic and relatively nonreactive. When fibers are spun from molten polyethylene terephthalate, and subsequently drawn to an elongation of about four and a half times their original length, substantially fully oriented fibers are formed.

Referring now to FIG. 1, it is thought that the molecules of polyester arrange themselves into readily ordered regions or crystallites 20 connected by tie chains and amorphous regions 22. When polyester is treated with a swelling agent, the crystallites 20 are thought to grow at the expense of the tie chains and amorphous regions 22 forming voids in the body of the fiber. When the swollen fiber is abraded, fibrils are formed on the convex portions of filaments of the textile material located near the surface of such textile material and project out from the body of the filament and the textile material, thereby imparting a pleasing appearance and touch to the textile material.

It is further thought that the portions of the molecule in a tie chain 22 are more accessible for reactions than the portion of the molecule in the crystallites 20. To form the preferred fibrillated polyester textile material of this invention, the polyester molecules of the polyester filaments employed to make up the textile material are severed in the tie chain portions of the molecule, and the fibers are contacted with a swelling agent. While the fibers are swollen, the fibers are abraded. Whether the tie chains are cut or not, similar methods are employed for abrading the swollen fibers within the fabric. Convenient methods include sanding, passage of the textile material around an arcuate member and exposure to an agitated fluid.

Tie chain scission is most easily accomplished by attacking the ester groups in the tie chain regions 22 of the molecules. Since the ester linkage in the tie chain portions of the molecule are more accessible for reaction than the linkages in the crystallites, tie chain scission can easily be accomplished by well known methods of reducing the molecular weight of polyesters. A summary of some of the more commonly used methods is provided in U.S. Pat. No. 3,396,446 which also provides useful concrete examples of procedures for lowering the molecular weight of polyesters. Of course, many other methods are known and the present invention is not limited to any particular method except as limited in the claims.

For the purposes of the present invention, tie chain scission is conveniently accomplished by immersing the textile material formed of a plurality of polyester fibers in a dispersion of an amine in water. The amount of tie chain scission which takes place will depend upon the amine chosen as well as the contact time, the temperature and the concentration of the amine; however, an indication of the amount of tie chain scission which has taken place in a filament can easily be obtained by comparing the breaking tenacity of the filament after treatment to the breaking tenacity of the untreated filament. The amount of fibrillation which will occur is increased appreciably if the breaking tenacity is decreased appreciably. Substantial fibrillation will occur if the breaking tenacity is reduced by at least about 10 percent. Since the fibers and thus the resulting fabric may not have the required strength for processing if the breaking tenacy is lowered too extensively, it is generally not advantageous to reduce the breaking tenacity of the fibers within the fabric by more than 50%.

Since the degree of fibrillation apparently increases with the degree of tie chain scission, it is normally advantageous to cut as many tie chains as it is possible to cut without lowering the strength of the fibers and thus the fabric below that required for the desired end use. Fortunately, polyester fibers are relatively strong so substantial weakening of the fibers can usually be tolerated.

If the tie chains are to be cut, after the filaments are swollen and the tie chains have been cut, then the filaments are fibrillated by abrading them while swollen. Suitable swelling agents are well known and include methylene chloride, acetone, chloroform, and mixtures of methylene chloride and formic acid among others.

Abrasion should be understood to include any method of imparting energy to the fibers within the fabric which preferentially imparts more energy to the regions of the fibers near the surface of the fabric than to the central portion, e.g. to the convex portion of the fibers near the surface of the fabric rather than the concave portion of such fibers. Mechanical energy may be imparted to the surface by many methods including: abrading the fibers by passing the textile material, e.g. fabric, around an arcuate member such as a blade or abrading them by agitating a fluid which is in contact with the fibers. In most cases, it is advantageous to abrade the fibers while they are immersed in the swelling agent, for example, a fabric which has been treated with an amine may be immersed in methylene chloride and abraded by sanding. Fabrics can be fibrillated by immersing either treated or untreated fabric in an agitated bath of swelling agent.

If the fabrics are abraded by sanding, a relatively fine grade of sand paper or crocus cloth should be used and the conditions should be controlled so that the fibers are not broken but are only abraded. The exact conditions used may vary widely depending upon the device employed, but if a fine grade of abrasive is used, the relative speed and the tension in the fabric are easily adjusted by eye by merely noting whether a substantial number of fibers are broken. If so, the tension or speed should be lowered and the process repeated until few, if any, fibers are broken but the fibers in the fabric are fibrillated. Such adjustments are well within the skill of those who are skilled in mechanical processing of fabrics.

If exposure to an agitated fluid is chosen as the method of imparting energy to the fiber within the fabric, it is most convenient to utilize the swelling agent as the agitated fluid. The process described above may be carried out on polyester textile materials, e.g. fabric, containing polyester fibers in any form including continuous filaments, false twist texturized yarns and the like.

Figure 11:
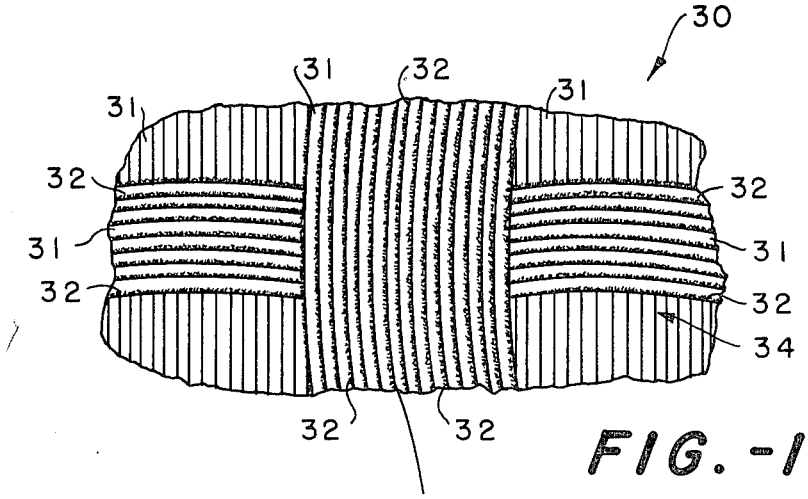
FIG. 11 is a schematic representation of a segment of a woven polyester textile material which has been fibrillated in accordance with the subject invention.
Figure 12:
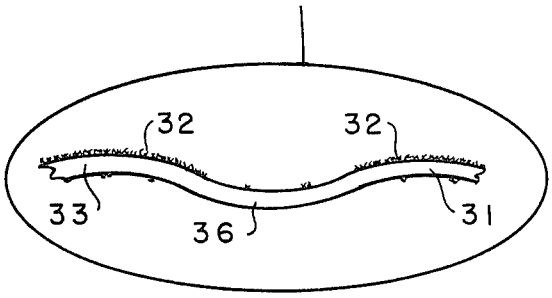
FIG. 12 is an enlarged schematic representation of a single filament of the fibrillated polyester textile material of FIG. 11.

With reference now to FIGS. 11 and 12, a portion of a fibrillated polyester textile material 30 is depicted containing a plurality of filaments 31. As indicated, the novel fibrillated polyester textile materials are produced so as to contain a plurality of integral fibrils 32 which project from filament 31 and/or distributed along the length of the convex portion 33 of filament 31 away from the body portion 34 of the textile material 30 and thus provide a surface appearance similar to that of a textile material formed of staple yarn while retaining the strength which is imparted by the filament. Such effect is also accomplished because the concave side portion 36 of filament 31 contains substantially no fibrils pointing towards the body portion 34 of textile material 30 so that little or no locking of such fibrils occurs within the textile material. In order to accomplish such an effect, it is necessary that the fibrillation be carried upon a textile material, e.g. a fabric rather than upon single filaments of such textile material. Thus, the effect produced is primarily a surface effect to fibrillate the convex portions of the filaments of a polyester textile material. As indicated before, the unique effect is believed achieved because little or substantially no fibrillation occurs at the concave portions of the filaments within the textile material. However, as is readily apparent to those skilled in the art, a minor amount of fibrillation may inadvertently occur on the concave portion of the filaments. Care should be exercised in fibrillating the polyester textile material to insure that such is maintained at a minimum to prevent any substantial locking of the fibrils within the textile material thereby resulting in a harsh feeling product which will not be acceptable in the industry.

Thus, filament 31 would be positioned within the textile material in such a manner that fibrils 32 would be located in close proximity to or within the plane forming the surface of either the face or back of the textile material.

By integral fibrils, it is meant that the fibrils in the filament form a single continuous unit rather than a discontinuous or non-integral unit such as would be formed if the fibrils were fixed to the body by the use of adhesive. As previously stated, the fibrils of the fibrillated polyester filaments of the polyester textile material which form the subject matter of this invention are formed from the body of the filament at the convex portion of the filament rather than being attached after being formed from some external source. To obtain the maximum benefits of the fibrillation process, it is desired that the aspect ratio of the fibrils on the convex portion of the filaments be at least about three, that is, it is desired that the length of the fibrils be at least three times the thickness of such fibrils. It is more preferred that the aspect ratio be at least about five. While there is no lower limit on the fibril thicknesses which are desired, substantial benefits are obtained when the thickness of the fibrils is substantially less than the thickness of the filament from which they are formed. It is preferred that the thickness of the fibrils be no more than about half the thickness of the filament and still more preferred that the thickness of the fibrils be less than about one-fourth the thickness of the filament. It is desirable that the fibrils be distributed over the surface of the filament at its convex portion, preferably there will be substantial portions of the convex portion of the filament having at least one projecting fibril for each three thicknesses of the length of the filament. It is still more preferred that at least three fibrils should be attached to each convex portion of the filament and such occurs in each thickness of the length of the fibril. For example, if the shape of the filament is substantially cylindrical, it is preferred that if a portion of the filament is considered and if the length of the convex portion of such filament is n times the diameter of the filament, then it is desired that the number of fibrils attached in that portion of that filament be at least about one-third n and preferably at least about 3n. It is not necessary that this condition be satisfied for every convex portion of the surface but only that it is satisfied over substantial convex portions of the surface.

The fibrillated polyester which forms the subject of this invention can be formed by swelling textile materials formed of polyester fibers and then imparting mechanical energy preferably to the surface portions of the external fiber portions of the textile material. By use of this method, it is possible to form novel fibrillated polyester fabrics which simulate fabrics containing natural fibers to some degree; however, it is possible to greatly increase the degree of fibrillation by chemically modifying the fibers of the textile material before fibrillation of same.

The following examples are provided to illustrate the invention more fully but are not to be understood to limit the invention which is defined solely by the claims.

EXAMPLE I

Figure 2:
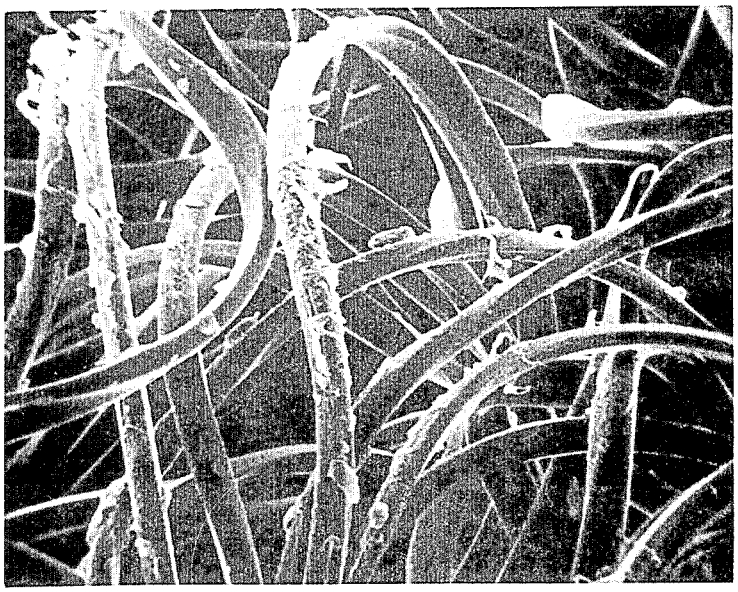
FIGS. 2 through 10 are scanning-electron-micrographs of a segment of a fibrillated polyester textile material produced in accordance with Examples I–IX, respectively, of the subject disclosure.

A single jersey fabric knit from continuous filament false twist texturized polyethylene terephthalate yarn of 150-denier/50-single-filaments was placed in a vessel containing methylene chloride at 75° F. and allowed to remain there for 30 minutes, after which time the fluid was ultrasonically agitated at a frequency of 25 kHz for 90 minutes. The power output of the ultrasonic agitation was 180 watts/cm$^2$ of surface of the ultrasonic "horn" used. After drying, the electron micrograph shown in FIG. 2 was taken showing fibrillation of the fibers.

EXAMPLE II

Figure 3:
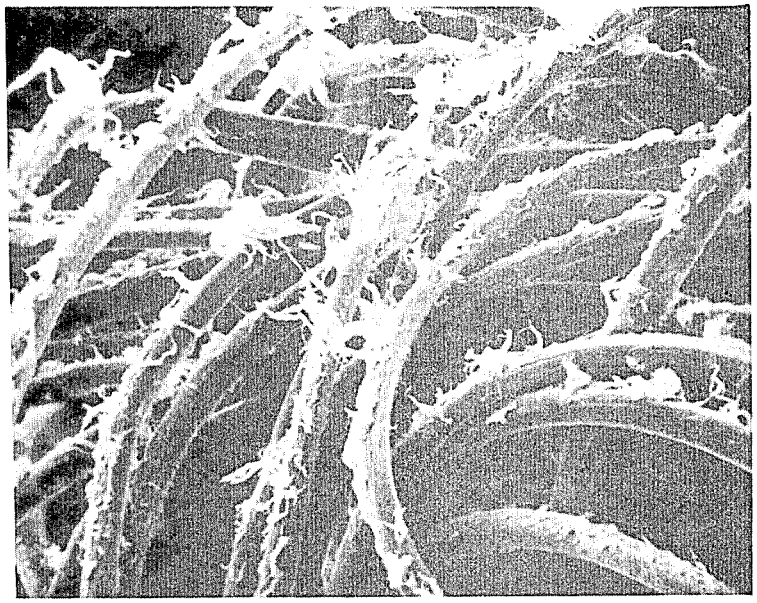

A fabric sample as described in FIG. 1 was treated with 7.9% N—COCO-1,3 diaminopropane [1] based on the weight of the fabric at 95° C. for 90 minutes. This reduced the breaking tenacity of the filament yarns in the fabric from 3.54 g/denier to 1.88 g/denier. The fabric was then placed in methylene chloride, soaked, and ultrasonically agitated as described in Example I. After the fabric was dried the electron micrograph shown in FIG. 3 was taken showing dense, excellent fibrillation.

[1]Duomeen ®C—a diamine manufactured and sold by Armak Industrial Chemicals Division of Akzona, Inc., of Chicago, Ill. and containing the following hydrocarbon chain length.

| DISTRIBUTION (PERCENT) | | |
|---|---|---|
| Alkyl Chain | | % |
| Hexyl | $C_6$ | 0.5 |
| Octyl | $C_8$ | 8.0 |
| Decyl | $C_{10}$ | 7.0 |
| Dodecyl | $C_{12}$ | 50.0 |
| Tetradecyl | $C_{14}$ | 18.0 |
| Pentadecyl | $C_{15}$ | — |
| Hexadecyl | $C_{16}$ | 8.0 |
| Septadecyl | $C_{17}$ | — |
| Octadecyl | $C_{18}$ | 1.5 |
| Tetra-decenyl | $C_{14'}$ | — |
| Hexa-decenyl | $C_{16'}$ | — |
| Octa-decenyl | $C_{18'}$ | 6.0 |
| Octa-decadienyl | $C_{18''}$ | 1.0 |

EXAMPLE III

Figure 4:
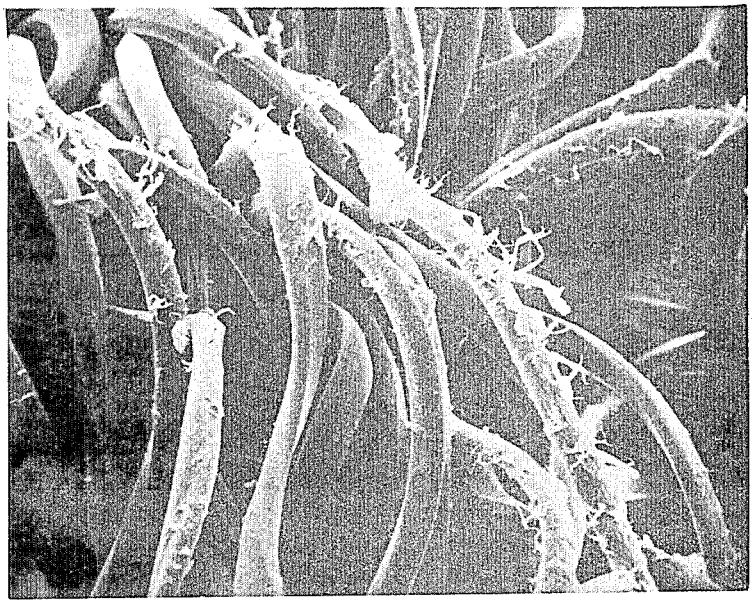

The procedure of Example II was repeated except that the fabric was heat set at 182° C. for 1 minute after treatment with the diamine and before immersion in the methylene chloride and the fabric was exposed to the ultrasonic agitation for only 60 minutes. Upon drying the electron micrograph shown in FIG. 4 was taken.

EXAMPLE IV

Figure 5:
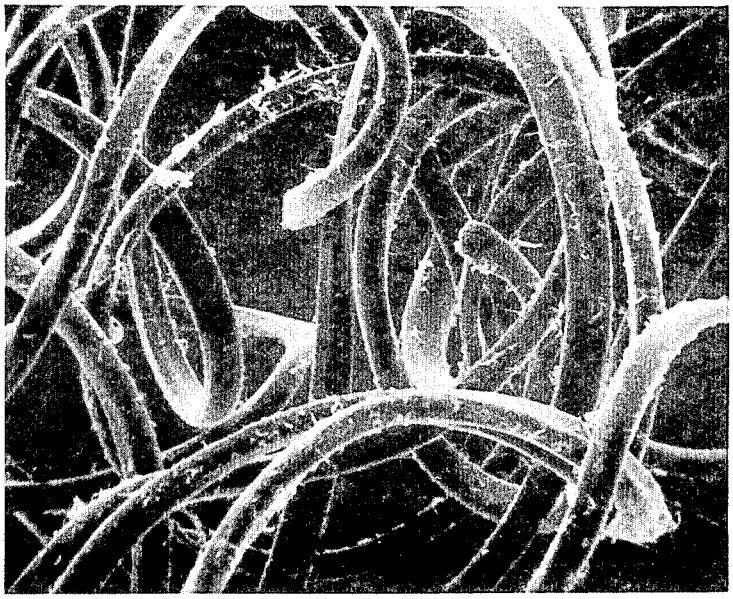

A fabric sample as described in Example I was treated with N—COCO-1,3-diaminopropane as described in Example II, the fabric was deknitted to obtain yarn which was immersed in methylene chloride for 30 minutes, then exposed to ultrasonic agitation as described in Example II for 60 minutes. Upon drying the electron micrograph shown in FIG. 5 was taken.

EXAMPLE V

Figure 6:
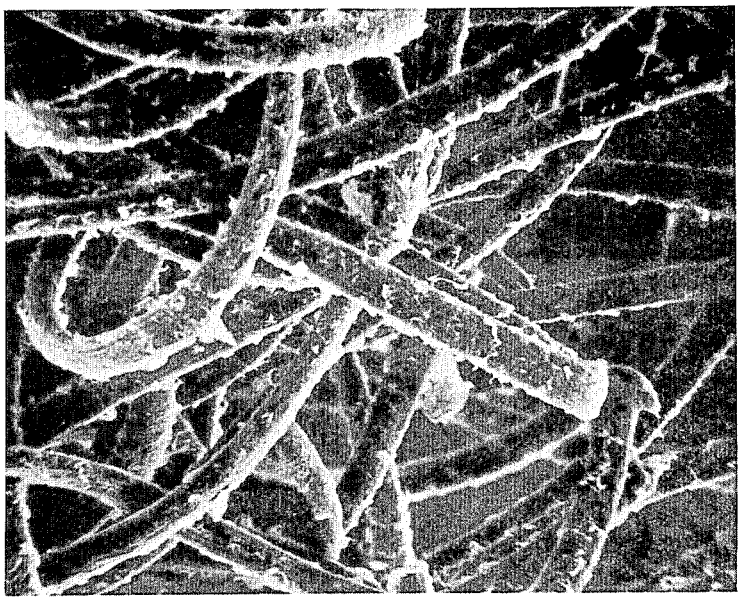

A polyester fabric sample as described in Example II was treated with N-COCO-1,3-diamonopropane as described in Example II. The sample was then immersed in a solution of 80% methylene chloride and 20% formic acid by weight for 30 minutes, then ultrasonic agitation was applied to the solution for 60 minutes. The electron micrograph shown in FIG. 6 was taken showing excellent fibrillation.

EXAMPLE VI (Sanding)

Figure 7:
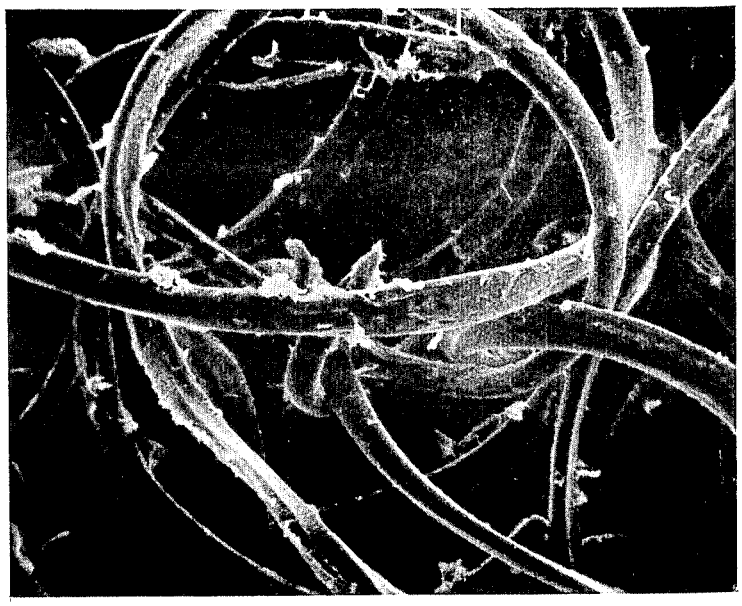

A fabric sample similar to that in Example I was treated with N—COCO-1,3-diaminopropane as in Example II. The fabric was immersed in methylene chloride for 30 minutes and then sanded with number 400 sandpaper while the fabric was still wet with methylene chloride. Upon drying, the electron micrograph shown in FIG. 7 was taken.

EXAMPLE VII (Edge Abrading)

Figure 8:
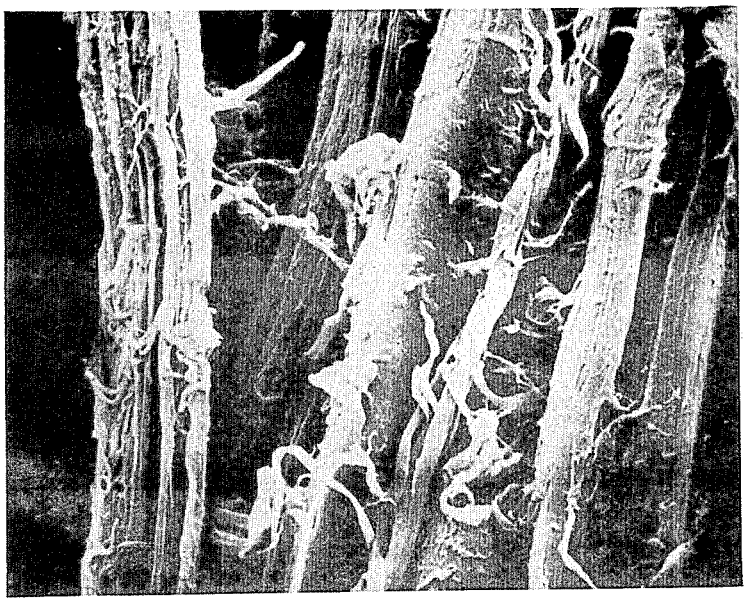

A polyester fabric was treated with N—COCO-1,3-diaminopropane as in Example II. The fabric was immersed in methylene chloride for 30 minutes and the under tension passed around a blade while immersed in methylene chloride. Upon drying, the electron micrograph shown in FIG. 8 was taken.

EXAMPLE VIII

Figure 9:
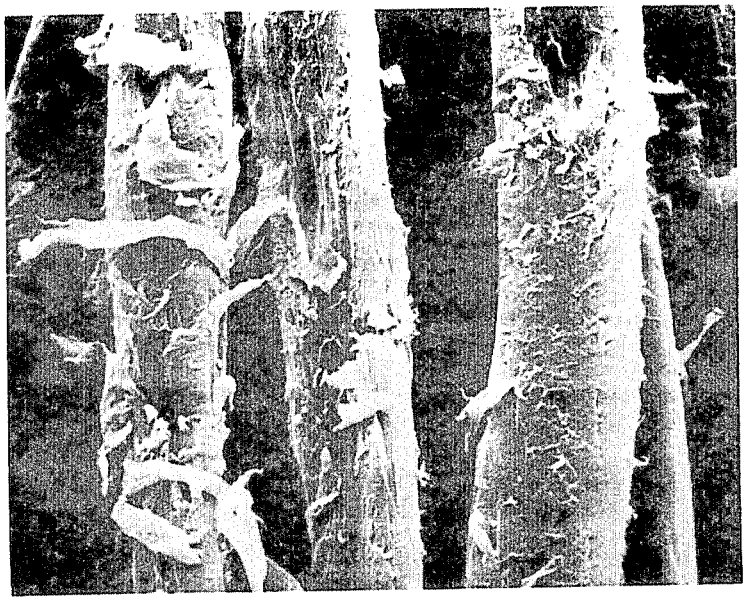

The procedure of Example VII was repeated except that the methylene chloride was replaced by acetone. Upon drying, the electron micrograph shown in FIG. 9 was taken.

EXAMPLE IX

Figure 10:
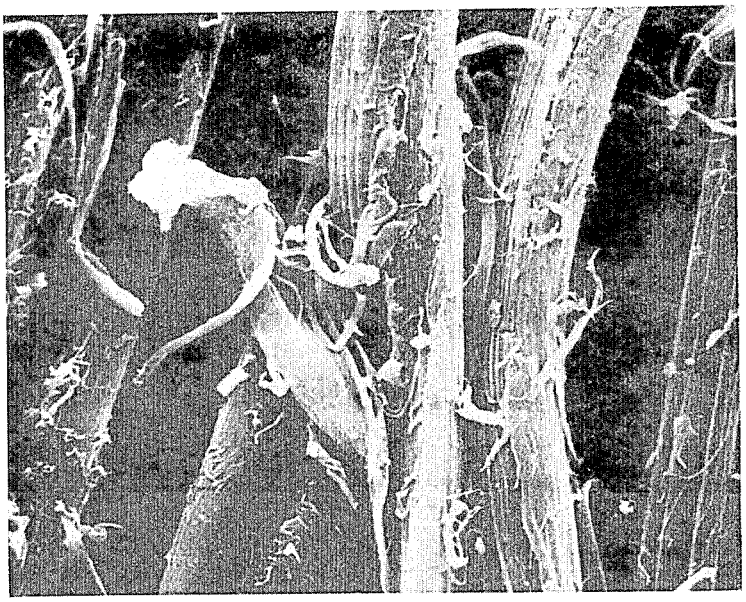

The procedure of Example VII was again repeated except that the methylene chloride was replaced by chloroform. Upon drying, the electron micrograph shown in FIG. 10 was taken.

As my invention, I claim:

1. A process for producing a fibrillated polyester textile formed of a plurality of polyester filaments in which said filaments have a curvature to provide a convex side portion and a concave side portion and the fibrillation occurs at the convex side portion of said filament extending away from the body portion of said textile material comprising the steps of:

swelling a polyester filament by immersion of a polyester textile material containing said filament in a liquid polyester swelling agent; and, ultrasonically agitating said liquid polyester swelling agent while said polyester textile material is immersed therein, for an effective amount of time and at an effective power to fibrillate said polyester filament.

2. The process of claim 1 which includes the step of reducing the breaking tenacity of the filament from about 10% to about 50% by cleaving ester groups in the tie chain portions of the polyester molecules in the filament prior to swelling of same.

3. The process for producing a fibrillated polyester textile material formed of a plurality of polyester filaments in which said filaments have a curvature to provide a convex side portion and a convex side portion and the fibrillation occurs at the convex side portion of said filament extending away from the body portion of said textile material comprising the steps of:

swelling a polyester filament by immersion of a polyester textile material containing said filament in a liquid swelling agent;

abrading the surface of said polyester textile material and thus said filament while same is in a swollen state.

4. The process according to claim 3 which includes the step of reducing the breaking tenacity of the filament from about 10% to about 50% by cleaving ester groups in the tie chain portions of the polyester molecules in the filament prior to swelling of same.

5. The process according to claim 4 wherein said abrading is by sanding.

6. The process according to claim 4 wherein said abrading is by passing the textile material around an arcuate path.

* * * * *